US005333459A

United States Patent [19]

Berger

[11] Patent Number: 5,333,459

[45] Date of Patent: Aug. 2, 1994

[54] DEVICE FOR OPERATING A SWIRLER WHICH CONTROLS COMBUSTION AIR OF A BURNER FOR GAS TURBINE ENGINES

[75] Inventor: Johann Berger, Moosburg, Fed. Rep. of Germany

[73] Assignee: MTU Motoren- Und Turbinen-Union Muenchen GmbH, Fed. Rep. of Germany

[21] Appl. No.: 77,460

[22] Filed: Jun. 17, 1993

[30] Foreign Application Priority Data

Jun. 19, 1992 [DE] Fed. Rep. of Germany ..... 4220060

[51] Int. Cl.[5] ..... F02C 3/14; F02C 9/16

[52] U.S. Cl. ..... 60/723; 60/748

[58] Field of Search ..... 60/39.23, 39.27, 39.24, 60/748

[56] References Cited

U.S. PATENT DOCUMENTS

| | | | |
|---|---|---|---|
| 2,655,787 | 10/1953 | Brown | 60/39.23 |
| 4,534,166 | 8/1985 | Kelm et al. | 60/748 |
| 4,542,622 | 9/1985 | Green et al. | 60/748 |
| 4,754,600 | 7/1988 | Barbier et al. | 60/39.23 |
| 5,159,807 | 11/1992 | Forestier | 60/39.23 |

FOREIGN PATENT DOCUMENTS 4110507 10/1992 Fed. Rep. of Germany .

*Primary Examiner*—Louis J. Casaregola
*Attorney, Agent, or Firm*—Evenson, McKeown, Edwards & Lenahan

[57] ABSTRACT

A device operates a swirling device which controls the flow rate of combustion air of a burner for gas turbine engines. At the head end of a combustion chamber, a ring body which is arranged coaxially with respect to the fuel nozzle is to have swirling ducts whose cross-sections are controllable by duct walls of a ring which is axially displaceable on the ring body. The axial displacement of the ring is to take place by means of a control piston which is axially displaceable in a housing, is spring-loaded on one side, is also actuated by a valve-controlled pressure difference existing on the spring side between an ambient pressure and a primary air pressure, controls openings communicating with the valve and the head end of the combustion chamber, and is acted upon on piston surfaces, which are free with respect to the housing, on the one side, by a pressure of supplied primary air existing at the head end and, on the other side, by the chamber pressure existing at the burner.

20 Claims, 2 Drawing Sheets

DEVICE FOR OPERATING A SWIRLER WHICH CONTROLS COMBUSTION AIR OF A BURNER FOR GAS TURBINE ENGINES

BACKGROUND AND SUMMARY OF THE INVENTION

The invention relates to a device for operating at least one swirling device which controls the flow rate of combustion air of a burner for gas turbine engines.

A known burner for gas turbine engines has at least one swirling device which can be controlled with respect to the flow rate of combustion air. This swirling device consists of a ring body which is coaxial to the nozzle and forms openings between profiles distributed uniformly along the circumference. Radially bent fingers of a sleeve engage in the openings. The sleeve is arranged in an axially adjustable manner on the outside on the ring body.

In this known burner, the fingers are web-type control bodies. These control bodies are constructed and arranged in such a manner that flow cross-sections can be adjusted which are variable in view of the axial sleeve adjustment and remain constant along the overall length. In this fashion, on at least one swirling device of a burner, the air flow rate operationally required for a low-pollutant and homogeneous combustion is made possible while a continuously uniform air swirl formation and therefore rotational swirl formation is maintained in the combustion chamber. In addition, a controllable air supply for additional primary air can be "superimposed" on at least one stationary swirling device in order to achieve a low-pollutant combustion in adaptation to the respective operating and load condition.

Particularly in view of an application in an annular combustion chamber, the above-mentioned device provides the use of a mechanically actuated adjusting system in order to be able to adjust all sleeves of the swirling devices simultaneously as a function of the load condition. The swirling devices are part of burners uniformly distributed along the circumference. In this case, the mechanical adjusting system comprises, among other components: an adjusting ring which is rotatably disposed on the circumference of the combustion chamber housing and to which one group of free ends of levers are pivotally connected. At the respective other end, the levers engage in a recess on the circumference of the respective sleeve. In addition, the levers each have an arm with a guide slot that is sloped relative to the burner axis. A pin, which in each case is fixedly connected with the respective sleeve, engages in the guide slot. An adjusting system of this type requires relatively heavy, cost-intensive, high constructional expenditures. In addition, it is susceptible to wear and disturbances. Also, the components of the adjusting system are subjected to load-cycle-dependent thermal differential expansions which may lead to adjusting inaccuracies and, in extreme cases, in component jamming.

There is therefore needed a device for at least one burner in accordance with the above-mentioned type which, while its construction is relatively simple, ensures a disturbance-free and reliable adjustment and control of the respective at least one burner-side swirling device.

These needs are met according to the present invention by a device for operating a swirling device which controls the flow rate of combustion air of a burner for gas turbine engines. The swirling device comprises on the head end of a combustion chamber a ring body with swirling ducts. The ring body is arranged coaxially with respect to the fuel nozzle. The cross-sections of the swirling ducts are controllable by means of duct walls of a ring which is axially displaceable on the ring body. The axial displacement of the ring takes place by means of a control piston which is axially displaceable in a housing, is spring-loaded on one side, is actuated by a valve-controlled pressure difference existing on the spring side between an ambient pressure and a primary-air pressure, and controls openings communicating with the valve and the head end of the combustion chamber and which, on piston surfaces which are free with respect to the housing, on the one side, is acted upon by pressure of supplied primary air existing on the head end, and, on the other side, is acted upon by chamber pressure existing at the burner.

DETAILED DESCRIPTION OF THE DRAWINGS

Figure 3:
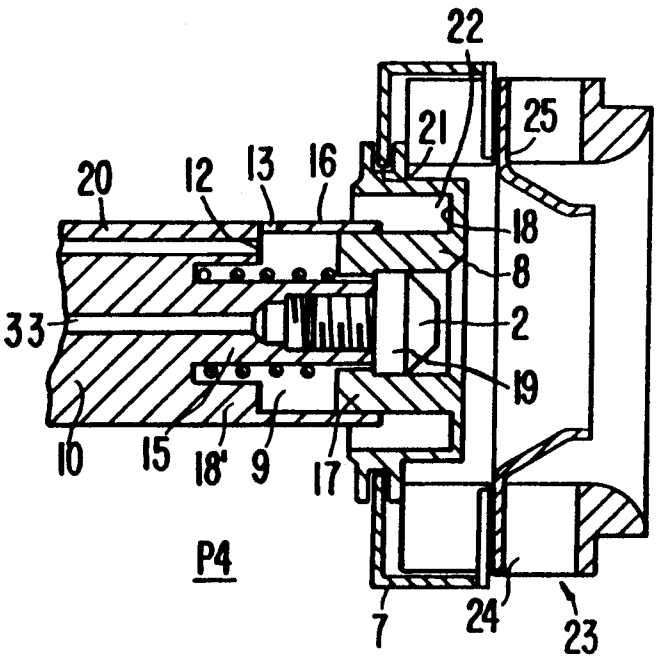
FIG. 3 is a longitudinal sectional center view of the burner according to FIG. 1, illustrating the end position of the swirling device which is completely closed on the air supply side.

FIGS. 1 to 4 illustrate a swirling device of a burner for gas turbine engines which controls the flow rate of combustion air and which has, on a head end 1 of a combustion chamber, a ring body 3 which is arranged coaxially with respect to the fuel nozzle 2. The ring body 3 forms, between profiles 4 distributed uniformly along the circumference, radial/tangential swirl ducts 5 in which fingers 6 (or control bodies) of a ring 7 engage. The fingers 6 can be axially adjusted on the outer circumference of the ring body 3. The ring 3 is connected with a piston-type control element 8 which is arranged in an annulus 9 of a housing 10 so that it can be axially adjusted against the restoring force of a spring 11. Basically, during the whole operating condition, there exists at the control element 8, on its surfaces which are free with respect to the housing, on the one side, the air pressure P1 existing at the head end 1 of the combustion chamber which consists of supplied primary air Pr and, on the other side, the chamber pressure P2 which exists downstream of the nozzle, according to a pressure relationship that remains essentially constant: $P1 \geqq P2$. At the annulus, on the spring side, at least two openings 12, 13 are provided which are exposed by the control element 8 in its first end position, and which are partially closed in its second end position. The spring side of the annulus 9 can be opened up (P3) or blocked, for example, with respect to the atmosphere via the one opening 12 by the switching of a shut-off valve 14. In the blocking position of the valve 14, i.e., the first end position of the control element 8, swirl ducts 5 are closed (FIG. 3). The annulus 9 is acted upon via the other opening 13 by a pressure P4 which is the result of the connection of the annulus 9 to the primary air supply Pr existing in the head end 1.

Between a cylindrical interior section 15 (FIG. 3) containing the fuel nozzle 2 and an exterior housing wall 16 of the housing 10 constructed as the nozzle support frame, the annulus 9 is formed into which the adjusting element 8 projects in an axially slidable manner via a ring segment 17. The face of the ring segment 17 extending on the spring side into the annulus 9 is acted upon by P4 according to FIG. 3.

The maximal axial adjusting path of the control element 8 is formed between an end portion 18 of the control element 8 and a surface F of the control element 8 opposite a section 19 of the fuel nozzle 2. The end portion 18 is located radially outward and downstream and is opposite the downstream end of the exterior housing wall 16. The section 19 is disposed on the downstream face of the interior section 15. As also illustrated, the control element 8 may partially be arranged in an axially displaceable manner on one section 19 (FIG. 3) of the fuel nozzle 2 which is rotationally symmetrically expanded with respect to the outside diameter of the interior section 15 and thus forms the one end stop opposite the corresponding opposite surface F (FIG. 4) on the ring segment 17 of the control element 8.

Figure 2:
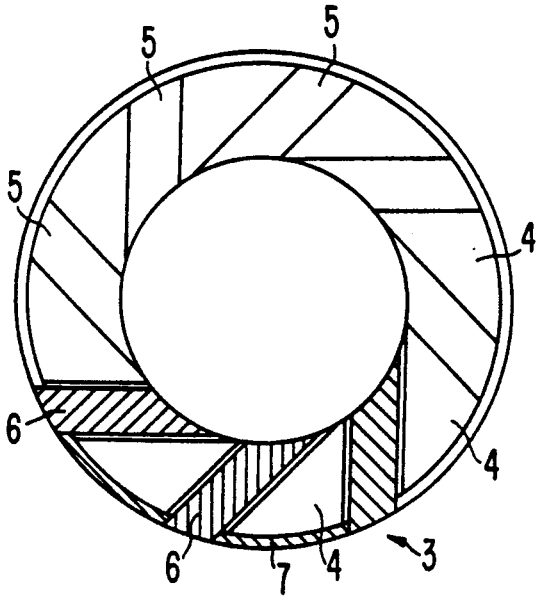
FIG. 2 is a cross-sectional view of the ring body of the swirling device in the viewing direction X of FIG. 1.
Figure 1:
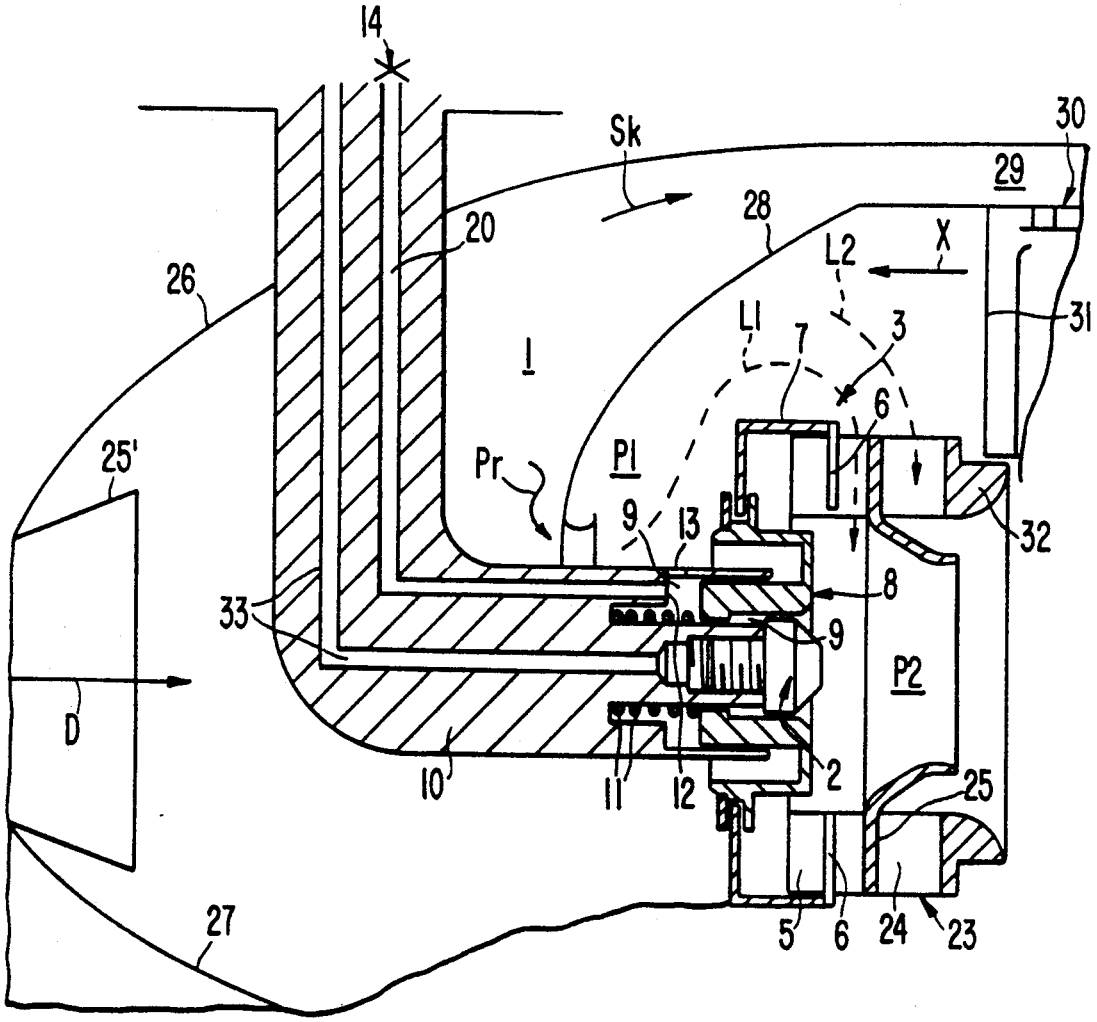
FIG. 1 is a longitudinal sectional center view of a burner on a burner nozzle assembly, together with a controllable swirling device on the head end of an annular combustion chamber, including upstream flame tube sections, an intermediate position of the finger-type control members actuated by way of the sleeve being illustrated.

It is constructionally expedient to provide a further development as shown particularly in FIG. 1 which is characterized in that the one opening 12 is connected to the valve 14 by way of a pipe 20 guided through the nozzle support frame into the housing 10.

Therefore, in the case of the present invention, the previously discussed maximal adjusting path of the control element 8 always at the same time, defines the maximal axial adjusting path of the sleeve-type ring 7 for the optional exposing or blocking of the swirl ducts 5.

In the interest of a reliable operation in view of differential expansions of the cooperating parts 7, 8, the ring 7 can engage in an exterior circumferential groove 21 (FIG. 3) of the control element 8 so that it moves along axially.

Advantageous mounting conditions are also achieved in that the control element 8, via a recess 22 which is open upstream and is coaxial to the nozzle, is at a radial distance with respect to the downstream end of the exterior wall 16 of the housing 10 serving as the nozzle support frame.

The piston-type control element and the sleeve ring may form a one-piece, axially adjustable component, which is not shown in the drawings. In this case, the control element 8 and the ring 7 may be manufactured as one piece. A 2-piece prefabrication according to FIGS. 1 to 4 would also be possible, in which case the ring 7 would be welded to the control element 8 on the groove 21.

According to FIGS. 1 to 4, a stationary swirling device 23 is in each case arranged on the burner behind the controllable swirling device with the ring body 3. By way of this swirling device 23, a portion of primary air which remains constant is supplied during the whole operating state according to the direction of the arrow L2 (FIGS. 1 and 4) by way of corresponding radial/tangential openings 24. In defined load phases, another controllable primary air portion L1 (FIG. 1 and FIG. 4) may be superimposed on the load portion L2 which always remains constant in order to produce a fuel-air mixture ("cold combustion") that is as rich in air and low in pollutants as possible. The openings 24 of the stationary swirling device 23 may be arranged with respect to the swirling ducts 5 (FIG. 2) of the controllable swirling device (ring bodies 3) radially/tangentially in the opposite direction. In this manner, mutually oppositely rotating rotational swirls W1; W2 may be generated in the primary zone of the combustion chamber which are enriched with fuel B (FIG. 4) from the nozzle 2 in order to achieve a homogeneous combustion that is low in pollutants.

On the burner, a shielding wall has the reference number 25 which aerodynamically separates the swirling devices, such as the ring bodies 3, the controllable swirling ducts 5 (FIG. 2), the stationary swirling device 23, the openings 24 with a fixed geometry, from one another. Radially/axially, as well as in a sleeve shape, as well as rotationally symmetrically with respect to the burner axis, the shielding wall 25 projects out from between the respective air outlet zones of both swirl generating devices. It may provide on the inside, downstream—while forming a convergent/divergent contour—a local depositing of very fine fuel droplets which are bound into the rotational swirl geometry W1, W2 in a fog-type or partially vapor-type manner.

Advantageously, the invention may also be used in the case of a burner concept in which, for example, two swirling devices with their ring bodies and the swirling ducts or openings contained in them would be controllable simultaneously by a ring with respect to the respective primary air flow. The latter may possibly take place in combination with a third swirling device which may be constructed to be stationary and may be arranged to be physically offset relative to the two other controllable swirling devices.

In the case of an annular combustion chamber for gas turbine engines, particularly jet engines, as illustrated analogously in FIG. 1, it would have to be assumed that in each case several burners of the type described in FIGS. 1 to 4 or of the type of the described controllable double whirling devices, are provided in a uniformly distributed manner along the circumference of the combustion chamber on the head end 1.

Concerning FIG. 1, it should be noted that the compressed air taken from the end of a high-pressure compressor is supplied, according to arrow D by way of an axial-flow diffuser 25' to the head end 1 which is formed between ring walls 26, 27 of the exterior housing. On the head end 1, upstream of a closing cap 28, the supplied compressed air D is divided into a primary air portion Pr as well as into secondary air portions Sk, the latter flowing off into annuli, for example 29, between the flame tube 30 and the ring walls 26 and 27. The burner is therefore, in each case, arranged between the rear wall 31 of the flame tube 30 and the closing cap 28 and, in this case, is held by means of the downstream lip end 32 on the rear wall 31 which is ring-shaped in this case.

Figure 4:
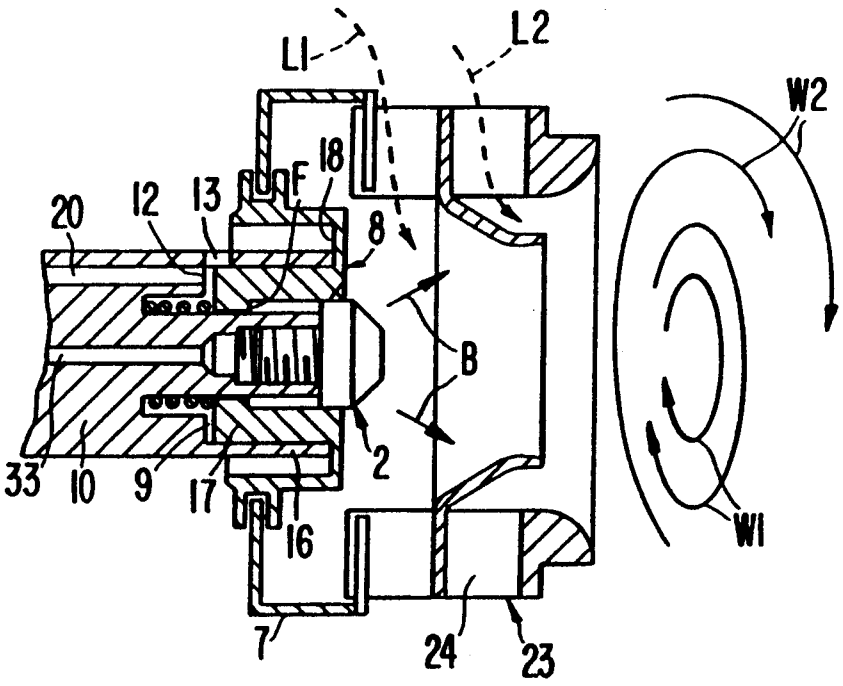
FIG. 4 is a longitudinal sectional center view of the burner according to FIGS. 1 and 3, illustrating the end position of the swirling device which is completely open on the air supply side.

In the position according to FIG. 4, the openings 12, 13 are partially blocked. This means that, at the opening 12, in this second end position of the control element 8, a primary-air leakage flow—in the open position of the shut-off valve 14—is ensured between the head end 1 of the combustion chamber by way of the spring-side remaining part of the annulus 9, then by way of the opening 12 and by way of the pipe 20, for example, to the atmosphere or to an airframe-side environment. Therefore, as illustrated in FIG. 4, in this case, the concerned face of the ring segment 17 of the control element 8 does not rest on the opening 12 in a completely sealing manner. During the operation, a differential pressure $P1 \geqq P2$ should be used as the basis which exists on the surfaces that are free of the housing, on both sides of the piston. In this case, P1, for example, may be approximately $3\% > P2$. The local pressure relief in the spring-side part of the annulus 9—when the valve 14 is opened with respect to the atmosphere—is sufficient for letting the control element 8 arrive, against the restoring force of the spring 11, in the second end position (FIG. 4).

As the result of the fact that, in the second end position of the control element 8, the openings 13 are only partially blocked, the required pressure buildup (P4) can take place optimally and rapidly when the shut-off valve 14 is switched to the blocking position; that is, the required primary air flow between the head end 1 and the part of the annulus 9 that is reduced on the spring side, is made available for the buildup of P4 so that, with the aid of the prestressing force of the spring 11, the control element 8 can be brought into the first end position (FIG. 3).

The at least one opening 13 may be constructed as a bore or as a slot.

In view of the second end position of the control element 8 (control piston)—FIG. 4—the possibility exists of providing a recess on the outer circumference of the ring segment 17 of the control piston 8. The recess corresponds in this end position with an opening or a slot in the exterior housing wall 16 in order to produce a throttled but not completely blocked fluidic connection between the head end 1 and the remaining part of the annulus 9 which is left on the spring side.

The shut-off valve 14 may be switchable as a function of the load condition of the engine. It may also be switched as a function of local pressures and/or temperatures in the combustion chamber.

A fuel supply pipe, which extends through the burner nozzle assembly 10 to the fuel nozzle 2 has the reference number 33 (FIG. 1).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A device for selectively opening and closing ducts of at least one first swirling device on a burner supplying combustion air to a combustion chamber of a gas turbine engine, said burner having a central fuel nozzle and including at least one second stationary swirling device for providing a constant supply of combustion air, said first and second swirling devices being arranged coaxially in a ring-shape with respect to the axis of the central fuel nozzle and having tangential ducts uniformly distributed along said ring shape, the device comprising:

a ring arranged to be axially displaceable in said ducts on an outer circumference of said first swirling device, said ring including inwardly bent fingers which extend into said ducts of the first swirling device;

a housing supporting the fuel nozzle;

a control piston connected with said ring, said control piston being arranged in an axially adjustable manner on said housing, wherein said housing has an annulus at a downstream end coaxial to said fuel nozzle, a section of said control piston being axially adjustable inside said annulus;

a spring arranged inside said annulus coupled at one end to said section of the control piston to load the control piston, wherein a downstream end of the control piston projects out of the housing, said downstream end of the control piston being free of said housing and being acted upon on an upstream side by a primary air pressure existing on a head end and a downstream side by a chamber pressure existing at the burner;

a shut-off valve coupling to a line in the housing;

openings in the housing for communicating the spring side portion of the annulus with the head end and said line from the shut-off valve;

wherein the control piston is actuated by a pressure difference, controlled by the shut-off valve, in the spring portion of the annulus between an ambient pressure and the primary air pressure such that, in a closed position of the shut-off valve, the openings are exposed by said section of the control piston and in an open position of the shut-off valve the openings are predominantly closed by said section of the control piston.

2. A device according to claim 1, wherein the housing is formed on a cylindrical support of the fuel nozzle and the control piston is displaceable against a spring in an annulus arranged coaxially with respect to the fuel nozzle, on openings controlled by the control piston on the spring side leading into the annulus, and at least one opening always being fluidically connected with the head end, and at least one other opening, when said shut-off valve is open, being connected to a low ambient pressure.

3. A device according to claim 2, wherein between a cylindrical section containing the fuel nozzle and an exterior housing wall of the housing constructed as a nozzle support frame, the annulus is formed into which the control piston projects via a ring segment in an axially displaceable manner.

4. A device according to claim 1, wherein a maximum axial adjusting path of the control piston is formed between an end part of the control piston which downstream and radially is on the outside opposite downstream end of an exterior housing wall, on the one hand, and a surface of the control piston which is disposed on the downstream face of an interior section opposite a section of the fuel nozzle, on the other hand.

5. A device according to claim 3, wherein a maximum axial adjusting path of the control piston is formed between an end part of the control piston which downstream and radially is on the outside opposite downstream end of an exterior housing wall, on the one hand, and a surface of the control piston which is disposed on the downstream face of an interior section opposite a section of the fuel nozzle, on the other hand.

6. A device according to claim 1, wherein the control piston is partially arranged on one section of the fuel nozzle in an axially displaceable manner, which section is rotationally symmetrically widened with respect to the outside diameter of an interior section and thus forms one end stop with respect to the corresponding opposite surface on a ring segment of the control piston.

7. A device according to claim 5, wherein the control piston is partially arranged on one section of the fuel nozzle in an axially displaceable manner, which section is rotationally symmetrically widened with respect to the outside diameter of an interior section and thus forms one end stop with respect to the corresponding opposite surface on a ring segment of the control piston.

8. A device according to claim 2, wherein one of said openings is connected to the valve by way of a pipe guided via a nozzle support frame into the housing.

9. A device according to claim 7, wherein one of said openings is connected to the valve by way of a pipe guided via a nozzle support frame into the housing.

10. A device according to claim 4, wherein the maximum axial adjusting path of the control piston always defines at the same time the maximal axial adjusting path of a sleeve-type ring for the optional exposure or blocking of the swirling ducts.

11. A device according to claim 9, wherein the maximum axial adjusting path of the control piston always defines at the same time the maximal axial adjusting path of a sleeve-type ring for the optional exposure or blocking of the swirling ducts.

12. A device according to claim 1, wherein the ring engages in an outer circumferential groove of the control piston so that it moves along axially.

13. A device according to claim 11, wherein the ring engages in an outer circumferential groove of the control piston so that it moves along axially.

14. A device according to claim 1, wherein the control piston extends a radial distance outward with respect to the downstream end of the exterior housing wall of the housing, via a recess which is open upstream and is coaxial to the nozzle.

15. A device according to claim 13, wherein the control piston extends a radial distance outward with respect to the downstream end of the exterior housing wall of the housing, via a recess which is open upstream and is coaxial to the nozzle.

16. A device according to claim 1, wherein the control piston and the ring form a one-piece, axially adjustable component.

17. A device according to claim 1, wherein at least one fluidic connection arranged in an exterior housing wall is formed between the annulus and the head end of the combustion chamber as one of a bore and a slot.

18. A device according to claim 17, wherein one of the bore and slot, in a second end position of the control piston, is connected with the spring-loaded side part of the annulus by way of at least one recess arranged on the exterior circumference of the ring segment of the control piston.

19. A device according to claim 1, wherein the shut-off valve is an engine load variable shut-off valve.

20. A device according to claim 1, wherein the shut-off valve is a combustion chamber variable shut-off valve.

* * * * *